United States Patent [19]

Urso

[11] Patent Number: 4,915,518

[45] Date of Patent: Apr. 10, 1990

[54] PRINTER AND RELATED MULTIFUNCTIONAL STAND

[75] Inventor: Paolo Urso, Villapia di Parabiago, Italy

[73] Assignee: Bull HN Information Systems Italia S.p.A., Caluso, Italy

[21] Appl. No.: 250,456

[22] Filed: Sep. 28, 1988

[30] Foreign Application Priority Data

Oct. 19, 1987 [IT] Italy ..... 22319 A/87

[51] Int. Cl.[4] ..... B41J 29/06

[52] U.S. Cl. ..... 400/681; 400/611; 400/613

[58] Field of Search ..... 400/680, 681, 611, 613, 400/613.4, 615; 248/471, 441.1, 466, 127; 226/196, 199

[56] References Cited

U.S. PATENT DOCUMENTS

| | | | |
|---|---|---|---|
| 1,331,442 | 2/1920 | Latta | 400/681 |
| 3,884,342 | 5/1975 | Mulholland | 400/681 X |
| 4,344,612 | 8/1982 | Leise et al. | 400/680 X |
| 4,402,624 | 9/1983 | Stall et al. | 400/681 |
| 4,531,852 | 7/1985 | Madge et al. | 400/680 X |
| 4,808,021 | 2/1989 | Kelly | 400/680 X |

FOREIGN PATENT DOCUMENTS

| | | | |
|---|---|---|---|
| 219624 | 4/1987 | European Pat. Off. | 400/680 |
| 2316077 | 10/1974 | Fed. Rep. of Germany | 400/680 |
| 2546998 | 3/1977 | Fed. Rep. of Germany | 400/681 |
| 60271 | 5/1981 | Japan | 400/681 |
| 2142879 | 1/1985 | United Kingdom | 400/680 |

*Primary Examiner*—Edgar S. Burr
*Assistant Examiner*—M. Patel
*Attorney, Agent, or Firm*—John S. Solakian; Gerald J. Cechony

[57] ABSTRACT

Printer for data processing system, the printer being for installation on a working desk, and comprising a multifunctional stand having a generic handle-form member hinged to the printer body near the edge defined by the base and the rear wall, the stand being pivotable to take a non operative position close to the base or the rear wall and at least one an operative position in which the stand is positioned below and apart from the base and supports the rear portion of the printer in a position spaced apart from the working desk.

3 Claims, 3 Drawing Sheets

PRINTER AND RELATED MULTIFUNCTIONAL STAND

The present invention relates to a printer and related multi functional stand, particularly a printer for data processing systems, personal computers and like.

It is known that the technology evolution has led to the development of data processing system output printers which are fast and compact.

They are contained in a casing of small size, in the generical form of a parallelepiped and can be placed on a working plane such as a desk or the like.

Such printers are generally intended for printing on a continuous form fanfolded so as to constitute a paper stack.

Very often such printers are also intended for printing on single sheets, in addition to the continuous form.

Paradoxically, in the use of such printers, which are designed to adapt to common office furniture, the printer support may be more obtrusive than the printer itself.

The two baskets are located in a manner suitable for assuring correct paper feed to the printer and the collection of the printed form.

These elements limit the capability of installing the printer in an office environment, particularly on a working table or desk.

These disadvantages are overcome by the printer and related multifunctional stand which is the object of the present invention.

The multifunctional stand allows for an easy and versatile installation in an office environment, meeting various possible needs.

These advantages are achieved by the adoption of a relatively stiff standing element in form of a square C-shaped handle, having its ends mounted in the printer frame, in a position close to the edge between the bottom and rear wall of the printer, and capable of assuming several working positions.

In a first working position the stand prevents interference of the continuous form with a possible edge of the supporting plane.

In a second working position the stand prevents the simultaneous feeding of a plurality of sheets of a continuous form.

In a third working position the stand holds the printer somewhat lifted from the supporting plane and allows for the insertion, at least partially below the printer, of a continuous form stack to be printed.

The stand can be easily mounted in the printer in a concealed way, so that the stand is not visible and does not disturb the printer's appearance when the installation operational conditions do not require its use.

These and other features and the advantages of the invention will appear more clearly from the following description of a preferred form of embodiment and from the appended drawings where:

Figures 1, 1A:
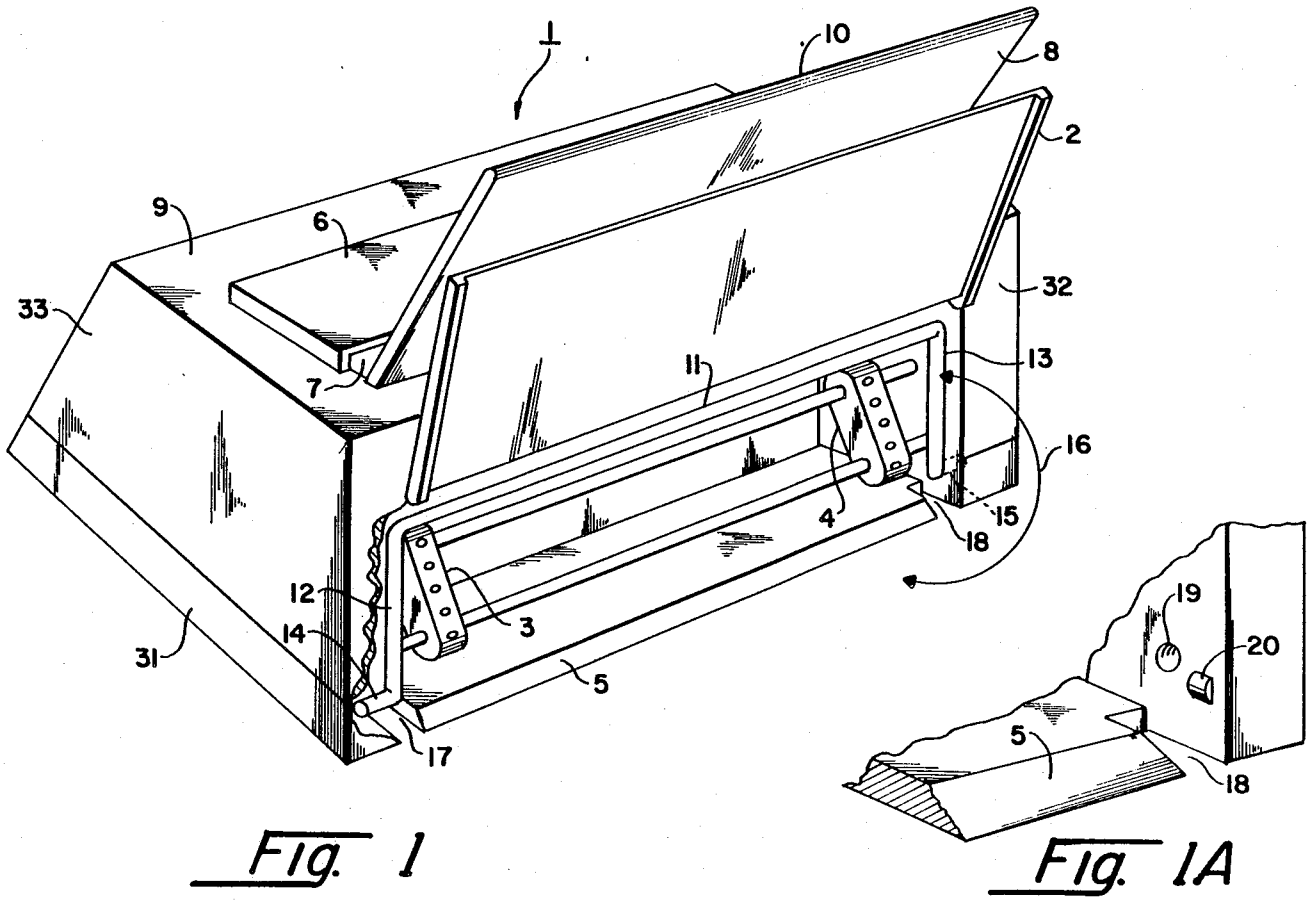
FIG. 1 shows in perspective view a printer having a multifunctional stand in accordance with the invention.
FIG. 1A shows a detail of the printer of FIG. 1.

Referring to FIG. 1, it shows in perspective view the body 1 of a printer, the body consisting of a base 31 and a cover 33 fixed to each other and forming a casing where the printer mechanisms and circuits are contained.

The printer rear wall 32 has an opening, closed by a panel 2. Through such an opening it is possible to enter an internal space where continuous form feeding tractors 3,4 are located.

Panel 2 is hinged to the printer body on the upper edge of the opening and, when closed, leaves a slot at the lower edge of the opening, allowing for the introduction of the printing form within the body.

The rear, lower edge of the body is suitably shaped so as to provide a guiding surface 5 to the continuous form entering the printer.

The upper panel 9 of the cover has a transparent window screen 6 allowing one to view inside, in the printing zone, and a slot 7 for the output of the printed form from the body.

In general a reading desk 8 is also provided, which extends up from the upper panel 9 with a suitable slope and onto which the printed form lays down. The upper edge 10 of the reading desk is suitably rounded and the printing form, once reaching the upper edge tends to fall on the rear of the printer.

According to the invention, the printer is provided with a multifunctional stand which can assume several operating positions.

The stand consists of a relatively rigid element, shaped in form of a square C and preferably fabricated from a metal rod having round cross-section.

As shown in FIG. 1, the stand comprises a rectilinear rod 11 having a length substantially equal to or slightly less than the width of the printer rear opening.

Rod 11 terminates in two arms 12,13 substantially at right angles with rod 11, and having a length substantially equal to or slightly less than the height of the rear opening.

Each of the arms 12,13 terminates in an appendix 14,15, folded at right angles and parallel to rod 11, and outward oriented, relative to the space comprised between the two arms.

The side edges of the rear opening each have an opening located close to the lower edge. The two appendices are inserted in such openings, so that the stand is hinged in such seats and can pivot around an axis defined by such seats.

The lower-rear edge of the printer body has two throats 17,18 which enable arms 12,13 to be inserted in such throats, so that the stand can pivot for a rotational arc greater than 180 deg. around its rotation axis, as shown by the arrow 16.

The stand can therefore take any position between two extremes, one in which the stand is housed in the rear space of the printer, as shown in FIG. 1, and one in which the stand is placed below the printer base, with a suitable forward orientation.

FIG. 1A shows, for a better understanding, a portion of the rear portion of the printer where a seat 19 is clearly visible, for housing the appendix 15 of the stand.

Throat 18 is further shown where a portion of arm 13 is inserted when the stand is placed downward.

A portion of the lower guiding edge 5 for the continuous form can also be seen.

Advantageously, the side wall of the rear opening has a prominence 20, suitably shaped, which constitutes a stop for the pivoting of the stand and defines for it a stable position in which the stand extends rearward of the printer body.

The relative resiliency of the stand enables it to overcome the stop 20, with reasonable effort, in order to move the stand in one or the other of the two angular fields defined by stop 20.

The use of a stand like the described one leads to substantial advantages in terms of printer functionalities as it clearly appears from FIGS. 2 to 5, which will now be discussed.

Figure 2:
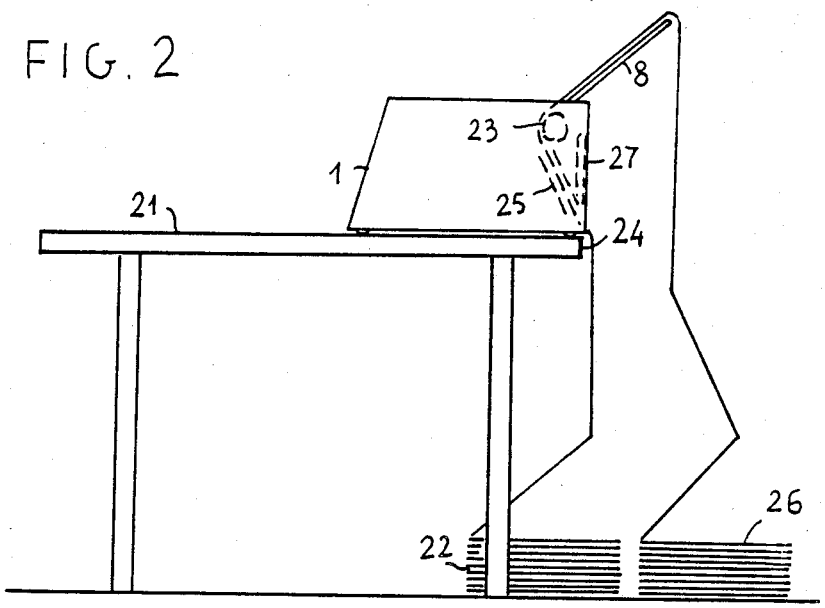
FIGS. 2,3,4,5 show in side view the printer and related multifunctional stand in several operative positions.

FIG. 2 shows in side view a printer supported on a desk in the unique position permitted to the prior art printers and deprived of the invention stand.

The printer 1 has to rest on the working plane in a position such that its rear wall is substantially in alignment with the rear edge of the working plane. A stack of continuous form segments 22 is placed below the table. The continuous form is fed through the printer by tractors 25 internal to the printer. They convey the form to a printing platen 23.

The printed form leaves the printer, lays down on reading desk 8, goes beyond its upper edge and falls rearward of the working plane 21 fanfolding to form a collection stack 26, normally resting on the floor. Stand 27, if provided, is not useful for this printer position and can be located inside the rear space of the printer, without interfering with correct printer operation.

It is to be noted that, in order to assure appropriate form feeding, stack 22 must be located so that the continuous form does not interfere with the rear edge of the working plane, in order to avoid undesired tearing, excessive friction and printer jamming.

This implies the positioning of stack 22 only partially below the working plane and the need to have available, on the rear of the table, a space sufficient to locate both stack 26 and (at least partially) stack 22.

Figure 3:
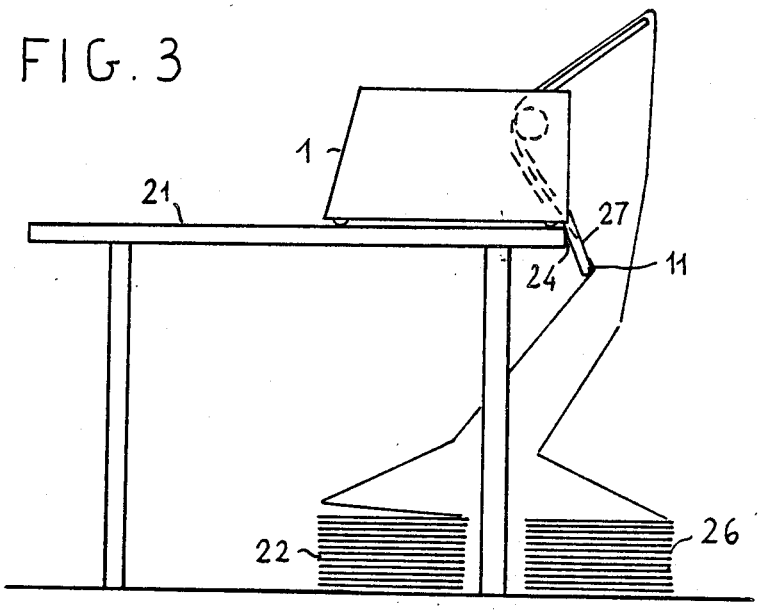

FIG. 3 shows how the use of the stand of the invention overcomes this limitation.

In FIG. 3 the printer is still resting on the working plane 21 with its rear wall aligned with the rear edge 24 of the working plane. The stand, in this case is withdrawn from the rear housing and is laid down so as to stop against the rear edge 24 of the working plane.

By this arrangement the stand rod 11 works as a guiding element for the continuous form and prevents its interference with the edge 24.

The stack 22 may therefore be located well below the working plane leaving space for partially or fully locating the collecting stack 26 below the table as well.

Figure 4:
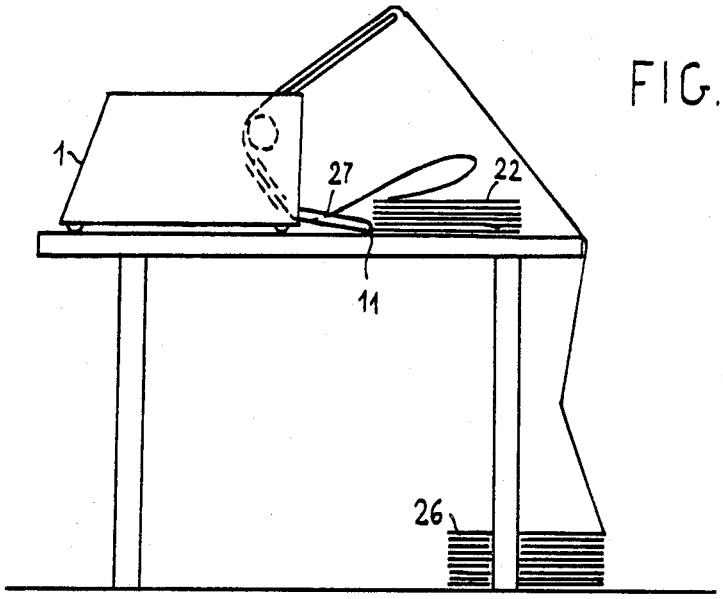

FIG. 4 shows an alternative use of the invention stand. In this case the printer is located in the front portion of the working plane and leaves available a rear portion where stack 22 may be placed.

The stand , withdrawn from the rear housing of the printer and laid down on the table, forms by its rod 11 a guide against which stack 22 is positioned.

Rod 11 assures that the stack remains far from the printer and prevents the stack, particularly in the depletion phase, from being pulled into the printer because of friction between the sheets, with consequential jamming.

The collecting stack may be obviously located below the table.

Figure 5:
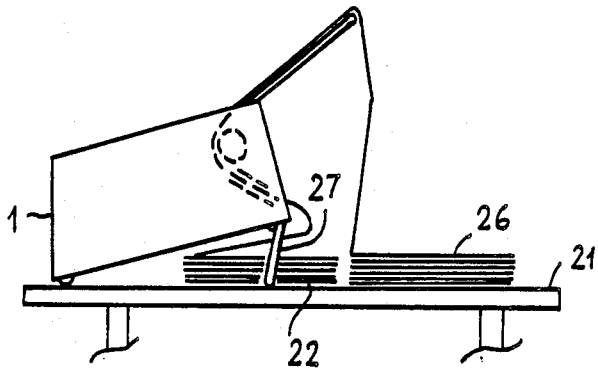

FIG. 5 shows an alternative installation way in which both the feeding stack 22 and the collecting stack 26 are located on a working plane.

To this purpose stand 27 is withdrawn from the printer and pulled down forward so as to act as a rear support for the printer. In this instance, the printer is located in a forward portion of the working plane and with its front edge supported thereon, whilst the rear portion is lifted from the plane by the stand.

The space available between the working plane and the printer bottom may be used to locate therein, at least in part, the feeding stack 22.

In this way the rear portion of the working plane 21 is free for locating therein the collecting stack 26.

In conclusion, the use of stand 27 allows for a great installation versatility of the printer.

Figure 6:
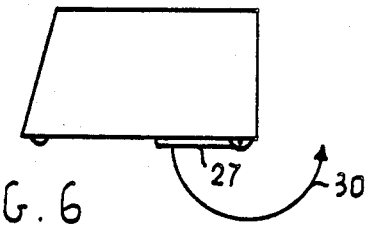
FIG. 6 shows in side view a printer and related multi functional stand of the invention with a mounting arrangement alternative to the one shown in FIG. 1.

It is clear that the preceding description relates only to a preferred embodiment of a printer having a stand, and that several changes can be made. For instance FIG. 6 shows in side view a printer in which the stand 27, rather than being mounted in a rear housing is mounted on the bottom of the printer and hinged in the vicinity of the rear feet. It can pivot according to the arc shown by arrow 30 and can take one or more stable positions.

Figure 7:
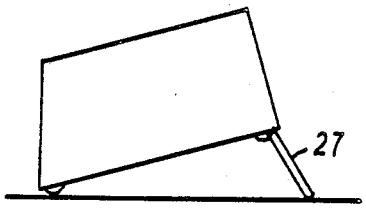
FIG. 7 shows the printer of FIG. 6 in one of the possible alternative operating positions.

FIG. 7 shows the printer of FIG. 6 with the stand steadily positioned so as to keep the rear portion of the printer lifted from the working plane.

Several stable position for the stand may be provided in well known manner with end stops or intermediate stops.

It is clear that in case of FIG. 6 the stand may be housed in a suitable recess provided in the bottom of the printer, so that the presence of feet, providing some clearance between the bottom and the working plane, is unessential from this point of view.

What is claimed is:

1. In combination, a printer for printing on fanfolded continuous forms having a feeding tractor internal of said printer, and a related multifunctional stand for selectively holding the rear portion of said printer spaced from a supporting surface of a working desk, said printer having a body with a base and a rear wall, said base and said rear wall meeting at a rear-lower edge, a recess in said rear wall, a first opening in said rear wall above said rear-lower edge for entering continuous forms in said printer from a feeding stack, a second opening for the output of said forms from said printer, said forms being pulled through said first opening from said feeding stack by said feeding tractor and once printed being discharged through said second opening to a collecting stack, said multifunctional stand being formed by a rectilinear rod and by two end arms perpendicular to said rod, one end of each of said arms being fixed with respect to a corresponding end of said rod, the other end of each of said arms being hinged in said body near said rear-lower edge so that said stand may pivot between a plurality of positions including a first non-operative position in which said stand is wholly contained in said recess, and a second operative position in which said stand supports the rear portion of said printer lifted from said desk to enable said feeding stack to be partially laid on said desk above said rod and at least partially below said rear portion of said body, and means in said body to maintain said stand in said second operative position in which said rod of said stand is spaced apart from said body and performs a supporting function for said body, so that a rear portion of said body is kept lifted from said desk by said rod resting on said desk.

2. Printer as claimed in claim 1, wherein said stand may be positioned in a third operative position, in which, and said printer is laid down with its base on said desk, and said rod is on said desk and spaced part from said body.

3. Printer as claimed in claim 1 wherein said means consists of two throats formed in said base, for receiving one of said arms in each of said throats.

* * * * *